US010736816B2

(12) United States Patent
Blancke et al.

(10) Patent No.: US 10,736,816 B2
(45) Date of Patent: Aug. 11, 2020

(54) CONTAINER FOR A LIQUID MEDICAMENT

(71) Applicant: SANOFI-AVENTIS DEUTSCHLAND GMBH, Frankfurt am Main (DE)

(72) Inventors: Stefan Blancke, Frankfurt am Main (DE); Axel Teucher, Frankfurt am Main (DE); Michael Jugl, Frankfurt am Main (DE)

(73) Assignee: Sanofi-Aventis Deutschland GMBH, Frankfurt am Main (DE)

( * ) Notice: Subject to any disclaimer, the term of this patent is extended or adjusted under 35 U.S.C. 154(b) by 452 days.

(21) Appl. No.: 15/543,500

(22) PCT Filed: Jan. 14, 2016

(86) PCT No.: PCT/EP2016/050663
§ 371 (c)(1),
(2) Date: Jul. 13, 2017

(87) PCT Pub. No.: WO2016/113347
PCT Pub. Date: Jul. 21, 2016

(65) Prior Publication Data

US 2018/0028400 A1 Feb. 1, 2018

(30) Foreign Application Priority Data

Jan. 16, 2015 (EP) ..... 15151367

(51) Int. Cl.
*A61J 1/10* (2006.01)
*A61J 1/14* (2006.01)

(52) U.S. Cl.
CPC ..... *A61J 1/10* (2013.01); *A61J 1/1406* (2013.01); *A61J 1/1475* (2013.01); *A61J 1/1493* (2013.01); *A61J 1/1468* (2015.05)

(58) Field of Classification Search
CPC ..... A61J 1/10; A61J 1/1406; A61J 1/1468; A61J 1/1475; A61J 1/1493
See application file for complete search history.

(56) References Cited

U.S. PATENT DOCUMENTS

| | | | | |
|---|---|---|---|---|
| 4,524,458 | A | 6/1985 | Pongrass et al. | |
| 6,505,986 | B1 | 1/2003 | Oder | |
| 2016/0082184 | A1* | 3/2016 | Hanagan ..... | A61M 5/14228 604/151 |

FOREIGN PATENT DOCUMENTS

| | | | | |
|---|---|---|---|---|
| GB | 756093 | | 8/1956 | |
| GB | 756093 | A * | 8/1956 | ..... B65D 35/14 |
| WO | WO 2014/058770 | | 4/2014 | |

OTHER PUBLICATIONS

International Preliminary Report on Patentability in International Application No. PCT/EP2016/050663, dated Jul. 18, 2017, 7 pages.

(Continued)

*Primary Examiner* — Benjamin J Klein
(74) *Attorney, Agent, or Firm* — Fish & Richardson P.C.

(57) ABSTRACT

The present disclosure relates to a container for a liquid medicament that includes a wall structure with at least one flexible portion and confining an inner volume filled with the liquid medicament and an elongated extraction tube having at least a first portion and a second portion that are separated from each other along the tube and which are located inside the inner volume. The extraction tube is radially collapsible when exposed to a compressive force above a predefined threshold, and the first portion, which is located at a distal end of the extraction tube, is less resistive against radial collapsing than the second portion.

18 Claims, 3 Drawing Sheets

(56) References Cited

OTHER PUBLICATIONS

International Search Report and Written Opinion in International Application No. PCT/EP2016/050663, dated Mar. 22, 2016, 9 pages.

* cited by examiner

CONTAINER FOR A LIQUID MEDICAMENT

CROSS REFERENCE TO RELATED APPLICATIONS

The present application is the national stage entry of International Patent Application No. PCT/EP2016/050663, filed on Jan. 14, 2016, and claims priority to Application No. EP 15151367.8, filed in on Jan. 16, 2015, the disclosures of which are expressly incorporated herein in entirety by reference thereto.

TECHNICAL FIELD

The present disclosure relates to the field of containers and reservoirs for liquid medicaments and in particular to reservoirs applicable for long-term storage as well as for administering a liquid medicament by means of a drug delivery device. The disclosure also relates to a respective drug delivery device equipped with such a container.

BACKGROUND

Drug delivery devices for administering liquid medicaments are widely known in the art. Parenteral administering of liquid medicaments is typically conducted by means of injection devices, such like syringes, pen-type injectors or by means of infusion pumps, e.g. by way of micropumps.

For treatment of chronic diseases, such like diabetes the medicament has to be regularly administered according to a predefined schedule. Known drug delivery devices may either be adapted for discrete use for injecting of a predefined amount of the medicament a given number of times during the day. Alternatively, such drug delivery devices may be adapted for continuous or quasi-continuous delivery of the medicament through a permanent fluid connection between the delivery device and the patient. Continuous or constant administering of the medicament is typically conducted by means of infusion pumps that are relatively expensive.

Such drug delivery devices typically comprise a reservoir to accommodate the liquid medicament and having an outlet in fluid communication with some kind of infusion or injection needle. Moreover, such drug delivery devices also comprise a drive mechanism that is operable to expel or to withdraw a predefined amount of the liquid medicament from the reservoir and through the infusion or injection needle into biological tissue of the patient.

There exist reusable as well as disposable devices, wherein with reusable devices the medicament-containing reservoir or container is to be replaced when empty. With disposable drug delivery devices a pre-filled reservoir is non-detachably arranged in the device. When the medicament contained therein has been used up the entire device is intended to be discarded.

Traditionally, vitreous or glass cartridges have been widely used in injection or infusion systems to contain or to accommodate the liquid medicament, hence a particular pharmaceutical composition. Glass cartridges, vials or carpules provide a large degree of optical transparency and are substantially inert to the medicament. This means, that substantially no interaction between the medicament and the glass cartridge takes place even under long term storage conditions, i.e. when the medicament is stored and contained in the cartridge for time intervals of severely years.

Vitreous cartridges or glass cartridges are prone to mechanical impact and may therefore represent a concern for patients but as well for the pharmaceutical industry. Glass breakage typically represents a hazard for the patient as well as for the industrial production environment. Moreover, handling of broken glass is quite risky and dangerous for the persons concerned with a broken cartridge.

Especially with highly concentrated medicaments and with infusion pump applications comparatively small volumes have to be injected or low volume flow rates have to be realized. Extraction and withdrawal of a comparatively small amount of medicament from a vitreous cartridge may be rather elaborate since a piston typically sealing a proximal end of the cartridge is to be displaced in distal, hence in injection direction typically by means of a plunger of the drug delivery device. For such application scenarios use of a deformable or flexible container or reservoir would be advantageous. As the medicament is sucked or withdrawn from the interior of the container the container is subject to a modification of its geometric shape and may start to collapse.

Containers filled with a liquid medicament are typically pierced or punctured by a cannula or a similar piercing element by way of which the liquid content of the container can be withdrawn therefrom. With many injection devices or drug delivery devices access to the interior of a flexible container is obtained by means of a piercing assembly, wherein a piercing element, such like a cannula or injection needle is displaceable relative to the injection device and relative to the flexible container in order to pierce a sidewall or a seal thereof. Reservoirs and containers to be used with infusion or injection devices may be flexible so as to facilitate a complete emptying of the container or reservoir. A container or reservoir with a flexible structure is of particular use when the medicament located therein is withdrawn by way of suction. The withdrawal of the medicament is then accompanied by a deformation or shrinking of the inner and outer dimensions of the respective container or its wall structure. As the sidewalls of a flexible container collapse or shrink they may block a fluid outlet thereby preventing a complete emptying of the container.

SUMMARY

Certain aspects of the present disclosure provide an improved container for a liquid medicament having a flexible wall structure that is collapsible as the medicament located therein is withdrawn. Certain aspects provide a container that enables a reliable and complete emptying of its content irrespective of its specific collapsing behavior. Certain aspects provide an interface for a container for a liquid medicament that enables a well-defined connection, disconnection as well as reconnection to a withdrawal device, such like a piercing assembly.

In some aspects, the improved container can be manufactured in a straight forward and cost efficient way. Moreover, the manufacturing of the container should be suitable for a mass manufacturing process.

In one aspect the disclosure relates to a container for a liquid medicament. The container comprises a wall structure with at least one flexible portion. The wall structure generally confines an inner or interior volume of the container which is filled with the liquid medicament. In addition the container comprises an elongated extraction tube having at least a first portion and a second portion. First and second portions are separated from each other along the extension of the tube. Both, first and second portions of the extraction tube are located inside the inner volume defined by the wall structure.

The extraction tube is radially collapsible when exposed to a compressive force above a predetermined threshold. In this context, a radial collapsing means that the sidewall of the extraction tube is displaceable radially inwardly so as to reduce the inner diameter of the extraction tube through which the liquid medicament may flow. The first portion of the elongated tube is located at a distal end of the extraction tube. The distal end is typically configured as a free end and is configured to receive liquid medicament from the inner volume and to conduct the received medicament towards a proximal portion of the extraction tube. The first portion at the distal end of the extraction tube is less resistive against radial collapsing than the second portion of the extraction tube, which is located proximally from the first portion of the extraction tube.

In this way, a controlled collapsing of the extraction tube is attainable which starts from the distal end of the extraction tube and propagates further towards a proximal portion or proximal end thereof as a compressive force acting on the extraction tube constantly rises.

Typically, the extraction tube acts and behaves or serves as a drain tube that is operable to transport and to conduct the liquid medicament from its distal end towards a proximal end, hence from the inner volume of the container towards the wall structure and eventually even therethrough.

By means of a varying radial collapsing resistivity in different axial regions of the extraction tube a well-defined axial collapsing behavior can be implemented. Typically, the first portion and hence the free end of the extraction tube exhibits the lower-most resistivity against radial collapsing. In proximal direction the collapsing resistivity may either stepwise or continuously increase. As a compressive force acting on the extraction tube constantly rises, the extraction tube continuously collapses in radial direction starting from its first portion or distal end towards the proximal direction. In this way, a well-defined axially propagating collapsing of the extraction tube itself can be provided by way of which the medicament contained in the extraction tube is transportable therethrough, even if the container has been already substantially emptied.

In this way even a residual amount of the liquid medicament located in the interior of the suction tube can be restlessly extracted from the container.

The wall structure may comprise a rigid portion but comprises at least one flexible portion, which due to an extraction of the liquid medicament from the inner volume of the container continuously adapts to the shape of the rigid wall structure so that the inner volume of the container continuously decreases and shrinks. It is even conceivable, that the entire wall structure is flexible and that the wall structure for instance comprises at least two sheets of an elastic material that are connected together, e.g. welded together along an outer circumference to form the flexible container.

The wall structure may form or constitute a flexible bag that may comprise or may consist of at least one of the following materials: thermoplastic elastomers (TPE), silicon rubber, butadiene rubber (BR), styrene butadiene rubber (SBR), styrene-ethylene/butylene-styrene type polymers (SEBS), LDPE, LLDPE, ethylene vinyl acetate (EVA), random copolymers of VP, polybutene-1, COC- or COP-based elastomers. The wall structure may alternatively comprise a comparatively thin layer of polymeric material. Then it may comprise or consist of one of the following materials or combinations thereof: MDPE, high-density polyethylene (HDPE), PP, in form of homopolymer, random or heterophasic copolymers, polybutene-1, COC, COP, polymethylene pentane, PET, Polyethylenterephthalat Glycol (PET-G), PBT, PC, SAN or MABS.

The wall structure of either rigid or flexible type may further comprise a transparent portion or is made of a transparent material to allow visual inspection of its content.

Typically, the extraction tube is compressible in radial direction by means of the collapsing wall structure of the container. As the liquid medicament is withdrawn from the container via the elongated extraction tube the wall structure and at least one flexible portion thereof abuts with the outer circumference of the elongated extraction tube due to the pressure level outside the container being larger than inside the container. As the pressure level inside the inner volume is further decreased, a compressive force acting on the wall structure, its at least one flexible portion and hence onto the extraction tube located inside the inner volume increases. By way of the inhomogeneous resistivity of the extraction tube along the main or axial extension thereof, the extraction tube starts to collapse in radial direction, thereby improving a complete emptying of its interior. Hence, a cavity inherently formed by the extraction tube collapses in a well-defined manner thereby supporting and enabling a complete withdrawal of medicament therefrom.

According to another embodiment the extraction tube is flexible and comprises a mechanical flexibility lower than the flexibility of the wall structure's flexible portion. In this way, it is the flexible portion of the wall structure that starts to deform as the liquid medicament is withdrawn from the inner volume via the extraction tube. Since the flexible portion of the wall structure is more flexible than the extraction tube the wall structure's flexible portion or the wall structure in its entirety is subject to mechanical deformation before the extraction tube becomes subject to radial collapsing. In this way, the extraction tube is configured to serve as a drain tube. As long as the wall structure is subject to mechanical deformation the elongated extraction tube substantially remains intact. It is only when the inner volume has been almost completely emptied that the wall structure has almost completely collapsed so that the flexible extraction tube located therein gets in contact or abutment with the wall structure and becomes subject to a compressive force.

Different mechanical flexibilities of the wall structure's flexible portion and of the extraction tube can be attained by making use of different elastic materials or by making use of different geometric structures. Hence, a comparatively thin wall structure is rather easily flexible while a rather thick wall structure may be comparatively rigid and stiff.

According to another embodiment the extraction tube is fixed to an inside-facing portion of the wall structure. In this way, the extraction tube is actually fixed and geometrically stabilized by the wall structure. It may be fixed to a rigid or to a flexible portion of the wall structure. By fixing the extraction tube to an inside-facing portion of the wall structure the extraction tube is effectively hindered to move relative to the wall structure. If the wall structure exhibits a specific and predefined collapsing behavior the extraction tube is typically fixed to a portion of the wall structure that collapses last or which portion, e.g. due to its specific geometry, serves as a liquid medicament collecting portion as the wall structure constantly collapses or shrinks while liquid medicament is withdrawn from the inner volume of the container.

According to another embodiment at least the first portion of the extraction tube is freed from the wall structure. Here, the first portion or the free end of the extraction tube is liberated and is free to move relative to the wall structure and inside the inner volume. Such a freed first portion of the extraction tube may be also beneficial, in particular when the wall structure of the container does not exhibit a well-defined and highly reproducible collapsing behavior. Given that the container, in particular its wall structure, does not exhibit a clearly reproducible collapsing behavior a movable first portion of the extraction tube may be of particular benefit. In the course of collapsing of the wall structure the first portion of the extraction tube may automatically arrange in a collecting portion or in a residual cavity of the collapsing wall structure. Hence, the free and movable end of the extraction tube may universally adapt to a variable collapsing behavior of the container's wall structure.

According to a further embodiment the extraction tube comprises a sidewall with numerous drain holes. By means of the drain holes the sidewall of the extraction tube is capable to receive liquid medicament from the inner volume of the container and to transport the collected liquid medicament towards the proximal outlet of the container. Even in an event where a free and open end of the extraction tube should be blocked, e.g. when in abutment with an inside-facing sidewall portion of the wall structure a further extraction of liquid medicament from the container may take place via the drain holes of the extraction tube.

Moreover, with numerous drain holes along the extension of the extraction tube a rather homogeneous collection and withdrawal of liquid medicament from the inner volume can be obtained.

According to another embodiment the first portion of the elongated extraction tube comprises an oval cross-section. An oval cross-section is beneficial to induce a well-defined collapsing behavior. An oval cross-section comprises a short axis and a long axis, typically extending at an angle of substantially 90° with respect to each other. As the first portion is subject to a homogeneous compressive force acting radially inwardly, the first portion will collapse along its short axis since an oval cross-section provides different mechanical collapsing resistivity along its short axis and its long axis. Typically, the collapsing resistance in direction of the long axis is larger than a respective collapsing resistivity in the direction of the short axis.

By way of modifying the cross-section of the extraction tube along the extraction tube the extraction tube can be provided with a varying radial collapsing behavior along its longitudinal or axial direction.

According to another embodiment the sidewall of the first portion comprises a variable thickness along its circumference. As seen in cross-section the first portion may comprise a sidewall portion of a rather large thickness adjacent to another sidewall portion of a reduced thickness. Typically, regions of reduced thickness naturally exhibit a lower degree of mechanical resistance against radial collapsing. By means of varying the thickness of the sidewall in the region of the first portion of the extraction tube the first portion's radial collapsing behavior can be modified in a well-defined way.

It is for instance conceivable, that the radial thickness of the sidewall of the first portion comprises a somewhat elliptic shape. Hence, the outer circumference of the cross-section of the first portion may be somewhat circular while the inner circumference of the first portion may be somewhat oval. Alternatively, it is conceivable that the outer circumference of the cross-section of the first portion is somewhat oval or elliptic while the inner circumference of the cross-section of the first portion is substantially circular. By modifying at least one of the cross-section of the first portion and the sidewall thickness of the first portion or by combinations thereof a large variety of different radial collapsing behaviors can be designed and implemented.

According to another embodiment the second portion comprises a substantially circular cross-section. In embodiments wherein the second portion is of circular cross-section and wherein the first portion is of oval cross-section or comprises a sidewall with a variable thickness along its circumference the extraction tube comprises a transition area between the first portion and the second portion. The oval cross-section of the first portion may smoothly or stepwise merge into a circular cross-section. Also a sidewall of the first portion with a variable thickness along its circumference may transfer or merge towards a sidewall in the second section of the extraction tube having a constant thickness along its circumference. Also these longitudinal variations in regard to the wall thickness of first and second portions of the extraction tube respectively may be rather smooth and continuous or may comprise a stepped profile. In longitudinal direction, hence in a direction defined by the distance between first and second portions of the extraction tube the cross-section of the extraction tube may vary smoothly or stepwise. The same may be also valid for the shape and profile or thickness of the extraction tube's sidewall in the first and the second portions.

Having different sidewall profiles in the first and in the second portions as well as having different cross-sections of the extraction tube in the first and second portions leads to different respective collapsing behaviors in response to external compressive forces. Typically, a circular-shaped cross-section inherently comprises a larger resistivity against radial collapsing compared to an oval cross-section. In a similar way, a sidewall structure having variations of the sidewall thickness exhibits a higher tendency to collapse in response to a compressive force compared to a sidewall having a constant sidewall thickness.

Hence, by variations of the geometric shape, in particular by variations of the cross-section of first and second portions and/or by variations of the sidewall thickness in first and second portions a well-defined longitudinal or axial collapsing profile or collapsing behavior of the extraction tube can be designed and provided.

According to another embodiment the first portion comprises a density of drain holes that is larger than a density of drain holes of the second portion. By increasing a density, hence a number of drain holes per surface section in the first portion compared to a density or number of drain holes in the second portion of the suction tube, the mechanical stability of the first portion of the suction tube is reducible. The drain holes themselves, in particular the density of drain holes acts as a structural weakening. By increasing the density of drain holes in the first portion its resistivity against radial collapsing can be reduced. By having variations in the density of drain holes from the first portion towards the second portion the mechanical resistivity of the first portion against radial collapsing can be reduced so that the extraction tube collapses from its first portion towards the second portion in response to a compressive force above a predefined threshold.

According to a further embodiment the first portion comprises drain holes that are larger than the drain holes of the second portion. Alternative or additional to a variation of the density of drain holes of equal size also the size of drain holes towards the distal end, hence towards or in the first portion can be increased. Likewise an increase of the density of drain holes the increase of the size of drain holes has a similar weakening effect on the first portion in regard to collapsing resistivity. It is also conceivable, that both the density of drain holes as well as the size or the geometric shape of the drain holes is subject to modifications in order to generate different collapsing behavior at different longitudinal positions of the extraction tube.

In another embodiment the container further comprises an interface member extending through the wall structure of the container. The interface member is configured to engage with a piercing assembly that is attachable or connectable to the interface member from outside the wall structure. The interface member may be provided by a rigid component non-releasably connected to the wall structure of the container and intersecting the wall structure. By means of the interface member access to the interior of the container can be provided.

Moreover, the interface member may further enable and support a proper handling of the container. By means of the interface member, the container, in particular its inner volume is typically releasably connectable to an injection device or drug delivery device. The piercing assembly may be configured as a component of such an injection device or may be provided as a separate piece to operably engage with the interface member in order to gain access to the inner volume of the container.

The interface member may comprise an injection molded plastic component having some kind of a fixing structure by way of which the piercing assembly can be releasably attached thereto and/or by way of which the container can be fixed in a respective compartment of an injection device.

In a further embodiment the extraction tube comprises a proximal portion connected to the interface member. The extraction tube may either extend through or extend into the interface member. The interface member may provide or act as a fluidic extension of the extraction tube. Supposed that the extraction tube, in particular its proximal end terminates at or inside the interface member, the interface member typically comprises some kind of a channel structure or a standardized connector in order to connect the interface member and hence the container to a correspondingly-shaped connector or tubing system by way of which the liquid medicament withdrawn from the inner volume of the container can be supplied to an application site, typically to a patient.

By means of the interface member it is possible that the distal end, hence the first portion of the extraction tube is freed from the wall structure of the container. In such an embodiment the interface member equally serves as a mount for the extraction tube.

In another embodiment the proximal portion of the extraction tube is blocked by a pierceable seal. The pierceable seal is typically of self-healing type. It is pierceable by a tipped piercing element, such like a hollow cannula or a comparative injection needle or withdrawal device. The pierceable seal may be integrated into the proximal portion of the suction tube. Alternatively it may be fixed in a fluid guiding channel structure of the interface member in direct fluid communication with the suction tube, in particular with its proximal portion. By means of a pierceable seal, the container can be connected and disconnected to and from the piercing assembly multiple times. Typically, the pierceable seal may be implemented like a septum known from pierceable cartridges of injection devices of pen-injector type. The piercable seal typically comprises or consists of an elastomeric material, e.g. a natural or synthetic rubber, such like bromobutyl-rubber.

In another embodiment the interface member comprises a guiding structure to engage with a fastening member of the piercing assembly. Typically, the guiding structure extends parallel to the extension of the proximal portion of the extraction tube or of a channel portion of the extraction tube forming a fluid guiding extension thereof. By having a guiding structure between the interface member and the piercing assembly the piercing assembly can be attached and fastened to the interface only through a well-defined and guided translational motion.

It is particularly intended that the piercing assembly comprises a piercing element that needs to be properly aligned to the pierceable seal prior to establishing a mutual engagement of guiding structure and fastening member. Hence, during a guided sliding motion of the piercing assembly relative to the interface member the piercing element of the piercing assembly actually penetrates the pierceable seal and gains fluid transferring access to the interior of the proximal portion of the extraction tube. The opposite end of the piercing assembly may be in fluidic connection with some kind of tubing or the like so that the liquid medicament located inside the inner volume of the container can be withdrawn towards such a tubing via the extraction tube and the piercing assembly's piercing element.

The total filling volume of the container confined by the wall structure may be smaller than 20 ml, 15 ml, 10 ml or even smaller than 5 ml. The filling volume may be larger than 1 ml or larger than 2 ml. In various embodiments it may be larger than 5 ml. The filling volume is typically larger than 1 ml or 2 ml but smaller than 10 ml or 5 ml. The total surface of the wall structure is typically smaller than 25 $cm^2$ or smaller than 10 $cm^2$ but larger than 1 $cm^2$ or larger than 2 $cm^2$. The total length of an arbitrary side edge of the wall structure may be smaller than 5 cm but larger than 1 cm. The total circumference of the container may be smaller than 20 cm, smaller than 15 cm or smaller than 10 cm. It may be larger than 2 cm or larger than 5 cm.

In another aspect the disclosure also relates to an injection device for administering a liquid medicament. The injection device comprises at least a container as described above. Optionally, the injection device may be also equipped with a piercing assembly to engage with the interface member of the container. Further optionally the injection device may comprise a tubing to get in fluid transferring interconnection with the inner volume of the container. Further optionally the injection device may comprise a pump or a similar feeder mechanism by way of which liquid medicament can be withdrawn or sucked from the inner volume of the container.

In the present context the distal end or distal direction denotes the end of the extraction tube, which is furthest away from the dispensing end. The proximal portion, proximal end or proximal direction of the extraction tube is located downstream of the distal end or distal portion thereof in regard to the flow of liquid medicament.

The term "drug" or "medicament", as used herein, means a pharmaceutical formulation containing at least one pharmaceutically active compound, wherein in one embodiment the pharmaceutically active compound has a molecular weight up to 1500 Da and/or is a peptide, a protein, a polysaccharide, a vaccine, a DNA, a RNA, an enzyme, an antibody or a fragment thereof, a hormone or an oligonucleotide, or a mixture of the above-mentioned pharmaceutically active compound, wherein in a further embodiment the pharmaceutically active compound is useful for the treatment and/or prophylaxis of diabetes mellitus or complications associated with diabetes mellitus such as diabetic retinopathy, thromboembolism disorders such as deep vein or pulmonary thromboembolism, acute coronary syndrome (ACS), angina, myocardial infarction, cancer, macular degeneration, inflammation, hay fever, atherosclerosis and/or rheumatoid arthritis, wherein in a further embodiment the pharmaceutically active compound comprises at least one peptide for the treatment and/or prophylaxis of diabetes mellitus or complications associated with diabetes mellitus such as diabetic retinopathy, wherein in a further embodiment the pharmaceutically active compound comprises at least one human insulin or a human insulin analogue or derivative, glucagon-like peptide (GLP-1) or an analogue or derivative thereof, or exendin-3 or exendin-4 or an analogue or derivative of exendin-3 or exendin-4.

Insulin analogues are for example Gly(A21), Arg(B31), Arg(B32) human insulin; Lys(B3), Glu(B29) human insulin; Lys(B28), Pro(B29) human insulin; Asp(B28) human insulin; human insulin, wherein proline in position B28 is replaced by Asp, Lys, Leu, Val or Ala and wherein in position B29 Lys may be replaced by Pro; Ala(B26) human insulin; Des(B28-B30) human insulin; Des(B27) human insulin and Des(B30) human insulin.

Insulin derivatives are for example B29-N-myristoyl-des(B30) human insulin; B29-N-palmitoyl-des(B30) human insulin; B29-N-myristoyl human insulin; B29-N-palmitoyl human insulin; B28-N-myristoyl LysB28ProB29 human insulin; B28-N-palmitoyl-LysB28ProB29 human insulin; B30-N-myristoyl-ThrB29LysB30 human insulin; B30-N-palmitoyl-ThrB29LysB30 human insulin; B29-N—(N-palmitoyl-Y-glutamyl)-des(B30) human insulin; B29-N—(N-lithocholyl-Y-glutamyl)-des(B30) human insulin; B29-N-(ω-carboxyheptadecanoyl)-des(B30) human insulin and B29-N-(ω-carboxyheptadecanoyl) human insulin.

Exendin-4 for example means Exendin-4(1-39), a peptide of the sequence H-His-Gly-Glu-Gly-Thr-Phe-Thr-Ser-Asp-Leu-Ser-Lys-Gln-Met-Glu-Glu-Glu-Ala-Val-Arg-Leu-Phe-Ile-Glu-Trp-Leu-Lys-Asn-Gly-Gly-Pro-Ser-Ser-Gly-Ala-Pro-Pro-Pro-Ser-NH2.

Exendin-4 derivatives are for example selected from the following list of compounds:

H-(Lys)4-des Pro36, des Pro37 Exendin-4(1-39)-NH2,
H-(Lys)5-des Pro36, des Pro37 Exendin-4(1-39)-NH2,
des Pro36 Exendin-4(1-39),
des Pro36 [Asp28] Exendin-4(1-39),
des Pro36 [IsoAsp28] Exendin-4(1-39),
des Pro36 [Met(O)14, Asp28] Exendin-4(1-39),
des Pro36 [Met(O)14, IsoAsp28] Exendin-4(1-39),
des Pro36 [Trp(O2)25, Asp28] Exendin-4(1-39),
des Pro36 [Trp(O2)25, IsoAsp28] Exendin-4(1-39),
des Pro36 [Met(O)14 Trp(O2)25, Asp28] Exendin-4(1-39),
des Pro36 [Met(O)14 Trp(O2)25, IsoAsp28] Exendin-4(1-39); or
des Pro36 [Asp28] Exendin-4(1-39),
des Pro36 [IsoAsp28] Exendin-4(1-39),
des Pro36 [Met(O)14, Asp28] Exendin-4(1-39),
des Pro36 [Met(O)14, IsoAsp28] Exendin-4(1-39),
des Pro36 [Trp(O2)25, Asp28] Exendin-4(1-39),
des Pro36 [Trp(O2)25, IsoAsp28] Exendin-4(1-39),
des Pro36 [Met(O)14 Trp(O2)25, Asp28] Exendin-4(1-39),
des Pro36 [Met(O)14 Trp(O2)25, IsoAsp28] Exendin-4(1-39), wherein the group -Lys6-NH2 may be bound to the C-terminus of the Exendin-4 derivative;

or an Exendin-4 derivative of the sequence des Pro36 Exendin-4(1-39)-Lys6-NH2 (AVE0010),
H-(Lys)6-des Pro36 [Asp28] Exendin-4(1-39)-Lys6-NH2,
des Asp28 Pro36, Pro37, Pro38Exendin-4(1-39)-NH2,
H-(Lys)6-des Pro36, Pro38 [Asp28] Exendin-4(1-39)-NH2,
H-Asn-(Glu)5des Pro36, Pro37, Pro38 [Asp28] Exendin-4(1-39)-NH2,
des Pro36, Pro37, Pro38 [Asp28] Exendin-4(1-39)-(Lys)6-NH2,
H-(Lys)6-des Pro36, Pro37, Pro38 [Asp28] Exendin-4(1-39)-(Lys)6-NH2,
H-Asn-(Glu)5-des Pro36, Pro37, Pro38 [Asp28] Exendin-4(1-39)-(Lys)6-NH2,
H-(Lys)6-des Pro36 [Trp(O2)25, Asp28] Exendin-4(1-39)-Lys6-NH2,
H-des Asp28 Pro36, Pro37, Pro38 [Trp(O2)25] Exendin-4(1-39)-NH2,
H-(Lys)6-des Pro36, Pro37, Pro38 [Trp(O2)25, Asp28] Exendin-4(1-39)-NH2,
H-Asn-(Glu)5-des Pro36, Pro37, Pro38[Trp(O2)25, Asp28] Exendin-4(1-39)-NH2,
des Pro36, Pro37, Pro38 [Trp(O2)25, Asp28] Exendin-4(1-39)-(Lys)6-NH2,
H-(Lys)6-des Pro36, Pro37, Pro38 [Trp(O2)25, Asp28] Exendin-4(1-39)-(Lys)6-NH2,
H-Asn-(Glu)5-des Pro36, Pro37, Pro38 [Trp(O2)25, Asp28] Exendin-4(1-39)-(Lys)6-NH2,
H-(Lys)6-des Pro36 [Met(O)14, Asp28] Exendin-4(1-39)-Lys6-NH2,
des Met(O)14 Asp28 Pro36, Pro37, Pro38 Exendin-4(1-39)-NH2,
H-(Lys)6-desPro36, Pro37, Pro38 [Met(O)14, Asp28] Exendin-4(1-39)-NH2,
H-Asn-(Glu)5-des Pro36, Pro37, Pro38 [Met(O)14, Asp28] Exendin-4(1-39)-NH2,
des Pro36, Pro37, Pro38 [Met(O)14, Asp28] Exendin-4(1-39)-(Lys)6-NH2,
H-(Lys)6-des Pro36, Pro37, Pro38 [Met(O)14, Asp28] Exendin-4(1-39)-(Lys)6-NH2,
H-Asn-(Glu)5 des Pro36, Pro37, Pro38 [Met(O)14, Asp28] Exendin-4(1-39)-(Lys)6-NH2,
H-Lys6-des Pro36 [Met(O)14, Trp(O2)25, Asp28] Exendin-4(1-39)-Lys6-NH2,
H-des Asp28 Pro36, Pro37, Pro38 [Met(O)14, Trp(O2)25] Exendin-4(1-39)-NH2,
H-(Lys)6-des Pro36, Pro37, Pro38 [Met(O)14, Asp28] Exendin-4(1-39)-NH2,
H-Asn-(Glu)5-des Pro36, Pro37, Pro38 [Met(O)14, Trp(O2)25, Asp28] Exendin-4(1-39)-NH2,
des Pro36, Pro37, Pro38 [Met(O)14, Trp(O2)25, Asp28] Exendin-4(1-39)-(Lys)6-NH2,
H-(Lys)6-des Pro36, Pro37, Pro38 [Met(O)14, Trp(O2)25, Asp28] Exendin-4(S1-39)-(Lys)6-NH2,
H-Asn-(Glu)5-des Pro36, Pro37, Pro38 [Met(O)14, Trp(O2)25, Asp28] Exendin-4(1-39)-(Lys)6-NH2;

or a pharmaceutically acceptable salt or solvate of any one of the afore-mentioned Exendin-4 derivative.

Hormones are for example hypophysis hormones or hypothalamus hormones or regulatory active peptides and their antagonists as listed in Rote Liste, ed. 2008, Chapter 50, such as Gonadotropine (Follitropin, Lutropin, Choriongonadotropin, Menotropin), Somatropine (Somatropin), Desmopressin, Terlipressin, Gonadorelin, Triptorelin, Leuprorelin, Buserelin, Nafarelin, Goserelin.

A polysaccharide is for example a glucosaminoglycane, a hyaluronic acid, a heparin, a low molecular weight heparin or an ultra low molecular weight heparin or a derivative thereof, or a sulphated, e.g. a poly-sulphated form of the above-mentioned polysaccharides, and/or a pharmaceutically acceptable salt thereof. An example of a pharmaceutically acceptable salt of a poly-sulphated low molecular weight heparin is enoxaparin sodium.

Antibodies are globular plasma proteins (~150 kDa) that are also known as immunoglobulins which share a basic structure. As they have sugar chains added to amino acid residues, they are glycoproteins. The basic functional unit of each antibody is an immunoglobulin (Ig) monomer (containing only one Ig unit); secreted antibodies can also be dimeric with two Ig units as with IgA, tetrameric with four Ig units like teleost fish IgM, or pentameric with five Ig units, like mammalian IgM.

The Ig monomer is a "Y"-shaped molecule that consists of four polypeptide chains; two identical heavy chains and two identical light chains connected by disulfide bonds between cysteine residues. Each heavy chain is about 440 amino acids long; each light chain is about 220 amino acids long. Heavy and light chains each contain intrachain disulfide bonds which stabilize their folding. Each chain is composed of structural domains called Ig domains. These domains contain about 70-110 amino acids and are classified into different categories (for example, variable or V, and constant or C) according to their size and function. They have a characteristic immunoglobulin fold in which two β sheets create a "sandwich" shape, held together by interactions between conserved cysteines and other charged amino acids.

There are five types of mammalian Ig heavy chain denoted by α, δ, ε, γ, and μ. The type of heavy chain present defines the isotype of antibody; these chains are found in IgA, IgD, IgE, IgG, and IgM antibodies, respectively.

Distinct heavy chains differ in size and composition; α and γ contain approximately 450 amino acids and δ approximately 500 amino acids, while μ and ε have approximately 550 amino acids. Each heavy chain has two regions, the constant region ($C_H$) and the variable region ($V_H$). In one species, the constant region is essentially identical in all antibodies of the same isotype, but differs in antibodies of different isotypes. Heavy chains γ, α and δ have a constant region composed of three tandem Ig domains, and a hinge region for added flexibility; heavy chains μ and ε have a constant region composed of four immunoglobulin domains. The variable region of the heavy chain differs in antibodies produced by different B cells, but is the same for all antibodies produced by a single B cell or B cell clone. The variable region of each heavy chain is approximately 110 amino acids long and is composed of a single Ig domain.

In mammals, there are two types of immunoglobulin light chain denoted by λ and κ. A light chain has two successive domains: one constant domain (CL) and one variable domain (VL). The approximate length of a light chain is 211 to 217 amino acids. Each antibody contains two light chains that are always identical; only one type of light chain, κ or λ, is present per antibody in mammals.

Although the general structure of all antibodies is very similar, the unique property of a given antibody is determined by the variable (V) regions, as detailed above. More specifically, variable loops, three each the light (VL) and three on the heavy (VH) chain, are responsible for binding to the antigen, i.e. for its antigen specificity. These loops are referred to as the Complementarity Determining Regions (CDRs). Because CDRs from both VH and VL domains contribute to the antigen-binding site, it is the combination of the heavy and the light chains, and not either alone, that determines the final antigen specificity.

An "antibody fragment" contains at least one antigen binding fragment as defined above, and exhibits essentially the same function and specificity as the complete antibody of which the fragment is derived from. Limited proteolytic digestion with papain cleaves the Ig prototype into three fragments. Two identical amino terminal fragments, each containing one entire L chain and about half an H chain, are the antigen binding fragments (Fab). The third fragment, similar in size but containing the carboxyl terminal half of both heavy chains with their interchain disulfide bond, is the crystalizable fragment (Fc). The Fc contains carbohydrates, complement-binding, and FcR-binding sites. Limited pepsin digestion yields a single F(ab')2 fragment containing both Fab pieces and the hinge region, including the H—H interchain disulfide bond. F(ab')2 is divalent for antigen binding. The disulfide bond of F(ab')2 may be cleaved in order to obtain Fab'. Moreover, the variable regions of the heavy and light chains can be fused together to form a single chain variable fragment (scFv).

Pharmaceutically acceptable salts are for example acid addition salts and basic salts. Acid addition salts are e.g. HCl or HBr salts. Basic salts are e.g. salts having a cation selected from alkali or alkaline, e.g. Na+, or K+, or Ca2+, or an ammonium ion N+(R1)(R2)(R3)(R4), wherein R1 to R4 independently of each other mean: hydrogen, an optionally substituted C1-C6-alkyl group, an optionally substituted C2-C6-alkenyl group, an optionally substituted C6-C10-aryl group, or an optionally substituted C6-C10-heteroaryl group. Further examples of pharmaceutically acceptable salts are described in "Remington's Pharmaceutical Sciences" 17. ed. Alfonso R. Gennaro (Ed.), Mark Publishing Company, Easton, Pa., U.S.A., 1985 and in Encyclopedia of Pharmaceutical Technology.

Pharmaceutically acceptable solvates are for example hydrates.

It will be further apparent to those skilled in the art that various modifications and variations can be made to the present disclosure without departing from the spirit and scope of the disclosure. Further, it is to be noted, that any reference numerals used in the appended claims are not to be construed as limiting the scope of the disclosure.

BRIEF DESCRIPTION OF THE FIGURES

In the following, an embodiment of the container with the collapsible extraction tube is described in detail by making reference to the drawings, in which.

DETAILED DESCRIPTION

Figure 1:
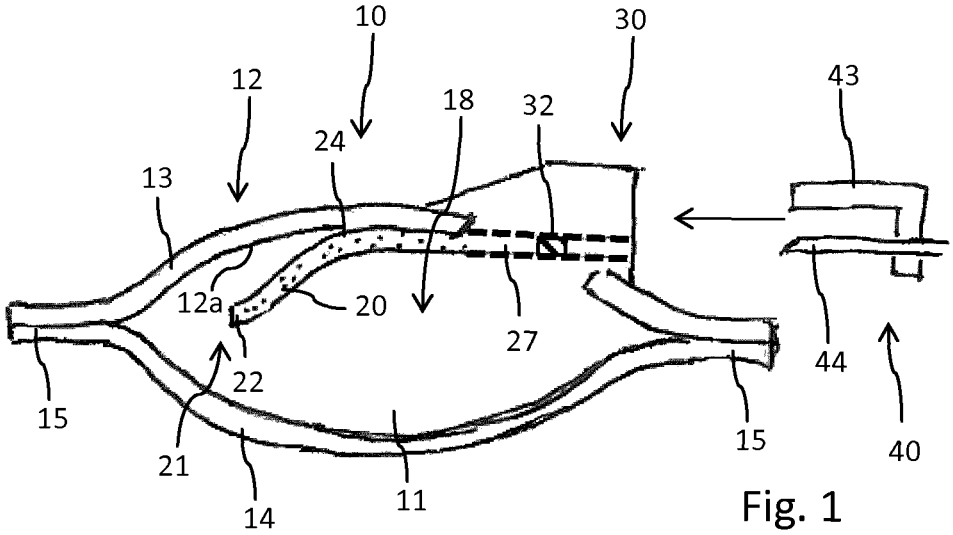
FIG. 1 shows a container for a liquid medicament according to the present disclosure in a longitudinal cross-section.

The container 10 as schematically shown in FIG. 1 comprises an inner volume 11 or an interior confined by a wall structure 12. In this embodiment the wall structure 12 is formed by an upper sidewall 13 and a lower sidewall 14. Both sidewalls 13, 14 may comprise a flexible material, such like an elastic foil. The two sidewalls 13, 14 may comprise a somewhat identical shape and circumference so that they are arrangeable on top of each other such that their side edges may be interconnected to form a seam 15. The overall geometric shape of the sidewalls 13, 14 is somewhat arbitrary. The two sidewalls 13, 14 mutually interconnected, e.g. mutually welded or adhesively connected along the surrounding seam 15 to form the inner volume 11 that may be completely filled with a liquid medicament 18.

It is generally conceivable that one of the sidewalls 13, 14 is rather rigid and inflexible while the other one of the sidewalls 14, 13 is flexible. The two sidewalls 13, 14 may form a flexible bag or pouch that is filled with the liquid medicament 18. Hence, at least one of the sidewall portions 13, 14 forms a flexible portion 13, 14 of the container's wall structure 12.

There is further provided an extraction tube 20 extending into the inner volume 11. As indicated in FIG. 1, the extraction tube 20 comprises a first portion 21 forming a free end thereof that is freed from an inside-facing portion 12*a* of the wall structure 12. Typically, the extraction tube 20 is flexible. It further comprises a first portion 22 forming a free end or distal end 21 thereof that is freed and moveable inside the inner volume 11 thanks to the flexibility of the extraction tube 20. The extraction tube 20 further comprises a second portion 24 that is located at a predefined longitudinal or axial distance from the first portion. Hence, the second portion 24 is located proximally offset from the distal end 21 of the extraction tube 20.

As can be seen in FIG. 1, the extraction tube 20 further comprises a proximal portion 27 opposite to the first portion 22 or opposite to the distal end 21. The proximal portion 27 is located inside or attached to a rigid interface member 30 that provides a well-defined coupling or connection to a piercing assembly 40. The proximal portion 27 is rigidly attached to the interface member 30. The interface member 30 is also attached to the wall structure and may extend through the wall structure so that the interface member 30 is accessible from outside.

Eventually, the extraction tube 20 is fixed with its second portion 24 to the inside-facing portion 12*a* of the wall structure 12. In this way, only a very distal end 21 of the extraction tube 20 is free to move inside the inner volume 11. Alternatively, it is conceivable that the entire section of the extraction tube 20 extending into the inner volume 11 of the wall structure 12 is free from the wall structure 12 or is completely fixed to an inside-facing portion 12*a* of the wall structure 12. Both embodiments may be beneficial for a complete emptying of the inner volume 11 depending on the geometry of the wall structure 12 and the flexible material or material combinations the wall structure 12 is made of.

Figure 2:
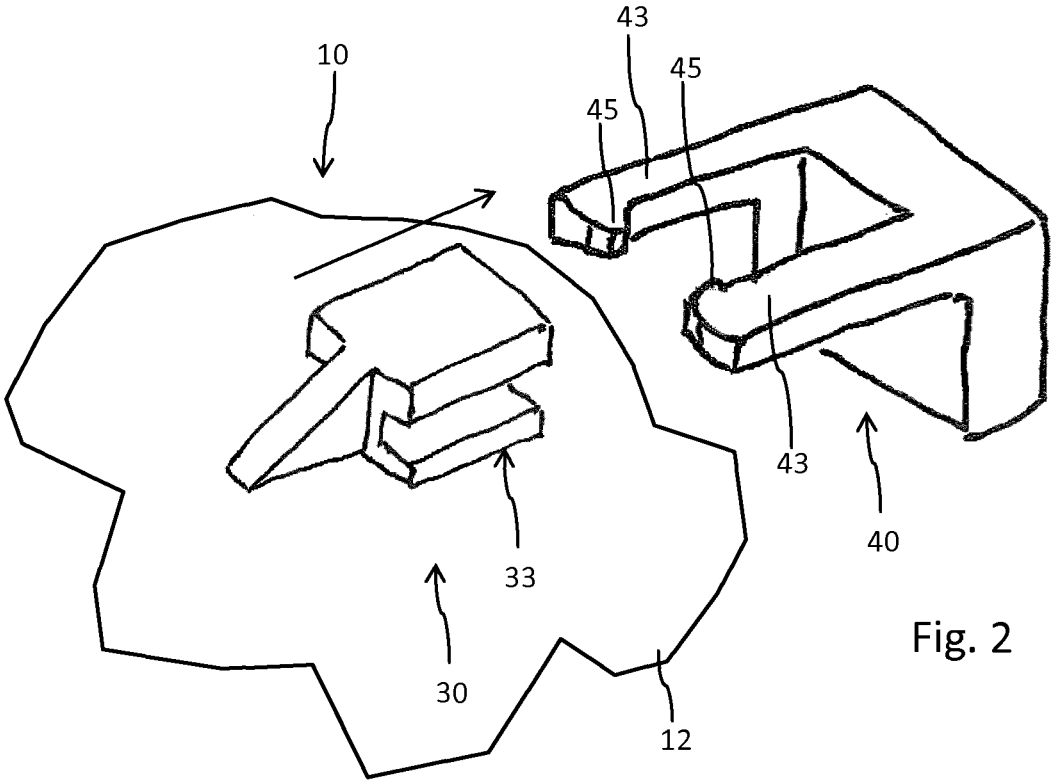
FIG. 2 is illustrative of the mechanical interaction of a piercing assembly and an interface member of the container according to FIG. 1.

As can be further seen from FIG. 1, the proximal portion 27 of the extraction tube 20 is blocked by a pierceable seal 32. The seal 32 and the proximal portion 27 are fixedly or rigidly attached to the interface member 30. They may be even located inside the interface member 30. As can be further seen from a combination of FIGS. 1 and 2 there is also provided a piercing assembly 40 having a fastening member 43 to engage with a guiding structure 33 of the interface member 30. Furthermore, the piercing assembly 40 comprises a piercing element 44 extending horizontal in the illustration according to FIG. 1. In particular, the piercing element 44, typically implemented as a hollow and tipped cannula extends parallel to the extension of the proximal portion 27 of the extraction tube 20 in which the pierceable seal 32 is located.

By aligning the piercing assembly's 40 fastening member 43 to the guiding structure 33 of the interface member 30 the piercing element 44 of the piercing assembly 40 is co-aligned with the seal 32. The elongation of the guiding structure 33 to engage with claw-like-shaped fastening members 43 of the piercing assembly requires that a mutual fixing of piercing assembly 40 and interface member 30 is obtained through a translational displacement of the piercing assembly 40 relative to the interface member 30 in a direction parallel to the elongation of the proximal portion 27. This translational displacement is sufficient for the piercing element 44 to enter the proximal portion 27 of the extraction tube 20 and to pierce and to intersect the pierceable seal 32.

The guiding structure 33, presently illustrated as a recessed groove on oppositely located sidewall portions of the interface member 30 engages with inwardly-facing prongs 45 of the claw-shaped fastening members 43 of the piercing assembly 40. In this way, a clip-like mutual fastening of the piercing assembly 40 and the interface member 30 can be obtained when the piercing assembly 40 has been translationally shifted relative to the interface member 30 as defined by the shape of the guiding structure 33 and its sliding interaction with the prongs 45 of the claw-shaped fastening members 43 of the piercing assembly 40. Even though not illustrated in FIG. 1 the end of the tipped piercing element 44 not penetrating the seal 32 or septum of the tube 20 is typically connected with some kind of further tubing in order to feed and to transport the liquid medicament to an injection site.

By means of the guiding structure 33 a well-defined and collisionless guiding of the distal tip of the piercing element 44 into and through the proximal portion 27 of the extraction tube 20 can be provided. Thanks to the guiding structure 33, a danger of inadvertently damaging the tipped end of the piercing element 44 can be effectively minimized.

Figure 3:
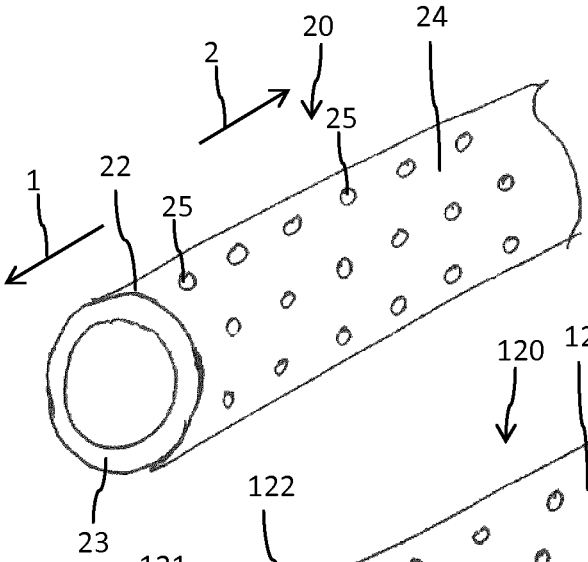
FIG. 3 shows one embodiment of a first and distal portion of an extraction tube of the container.

In FIG. 3 the shape and configuration of a first embodiment of the extraction tube 20, in particular of its first portion 22 is schematically illustrated. The first portion 22 forms the distal end 21 of the extraction tube which is open at its distal front face. In addition the first portion 22 comprises numerous drain holes 25 regularly arranged across the sidewall 23 of the extraction tube. The drain holes 25 homogeneously extend over and across the outer circumference of the sidewall 23 of the extraction tube 20 and even extend into a second portion 24 of the extraction tube 20.

In the embodiment according to FIG. 3 the first portion 22 of the extraction tube 20 exhibits and comprises a lower resistivity against radial collapsing than the second portion 24. This is e.g. obtainable by reducing the thickness of the sidewall 23 towards the distal end 21, hence from the second portion 24 towards the first portion 22.

Figure 4:
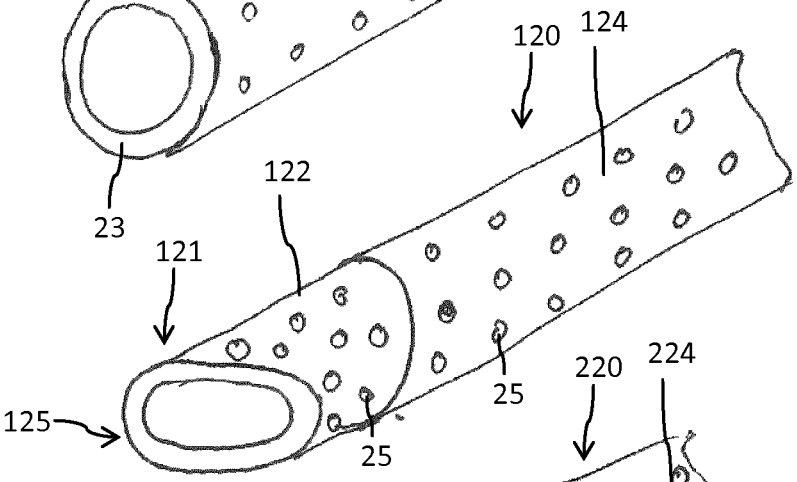
FIG. 4 shows another embodiment of the extraction tube.

In another embodiment as shown in FIG. 4, the extraction tube 120 comprises a distal end 121 formed by a first portion 122. Longitudinally adjacent to the first portion 122 there is provided a second portion 124. As can be seen from the schematic illustration of FIG. 4, the cross-section 125 of the first portion 122 is somewhat oval, while the cross-section of the second portion 124 is substantially circular. Here, a density or geometry of the individual drain holes 25 may be homogeneous across first and second portions 122, 124. Simply by changing the geometry and the cross-section of the first portion 122, the first portion 122 exhibits and comprises a lower resistivity against radial collapsing than the second portion 124.

In effect and upon complete emptying of the container 10, the collapsing wall structure 12 starts to exert a compressive force to the extraction tube 20. Thanks to the oval cross-section 125 in the first portion 122 the first portion starts to collapse, thereby expelling a liquid substance located therein in proximal direction and further towards the second portion 124. As the compressive force or pressure acting on the extraction tube 20 raises further, also the second portion 124 will start to collapse, typically starting from distal direction towards the proximal direction.

Figure 5:
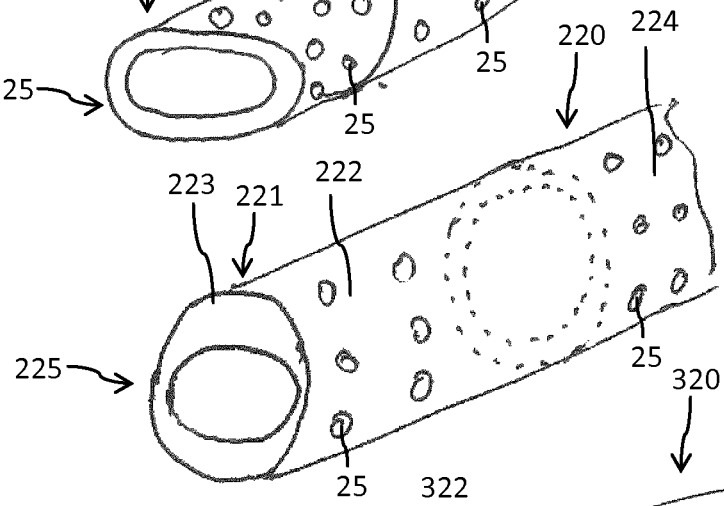
FIG. 5 shows a further embodiment of the extraction tube.

In another embodiment as shown in FIG. 5 the extraction tube 220 also comprises a distal end 221 formed by a first portion 222. As can be seen in the illustration according to FIG. 5, the overall outer cross-section of the first portion 222 is somewhat circular. Here, the inner cross-section 225 is oval-shaped. This is obtained due to variations in the thickness of the sidewall 223 of the first portion 222 compared to the second portion 224.

As shown in FIG. 5, the thickness profile along the circumference of the sidewall 223 is somewhat oval. A left and right sidewall portion as shown in FIG. 5 have a somewhat reduced thickness whereas upper and lower portions of the sidewall 223 are substantially thickened compared to the sidewall thickness as indicated by dotted lines in the second portion 224. An inhomogeneous thickness or varying thickness of the sidewall 223 along the circumference of the cross-section of the first portion 222 leads to a structural weakening and to a reduced resistivity against collapsing in response to an application of a compressive force.

Figure 6:
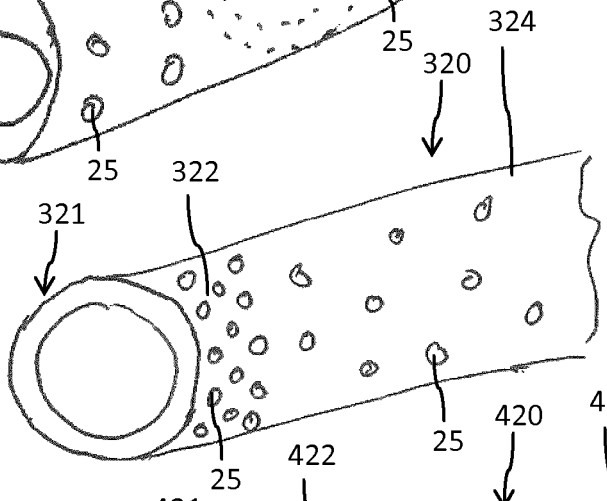
FIG. 6 shows another embodiment of the extraction tube.

In the embodiment according to FIG. 6 the extraction tube 320 also comprises an open distal end 321 formed by a first part 322. Also here, the first part 322 is offset in longitudinal direction from a second part 324. But in contrast to the embodiments as shown in FIGS. 3, 4 and 5 the density of drain holes 25 is larger in the first portion 322 compared to the second portion 324. The increase in density of drain holes 25 also leads to a structural weakening of the first portion 322, which therefore also exhibits a reduced resistivity against radial collapsing compared to the second portion 324.

Figure 7:
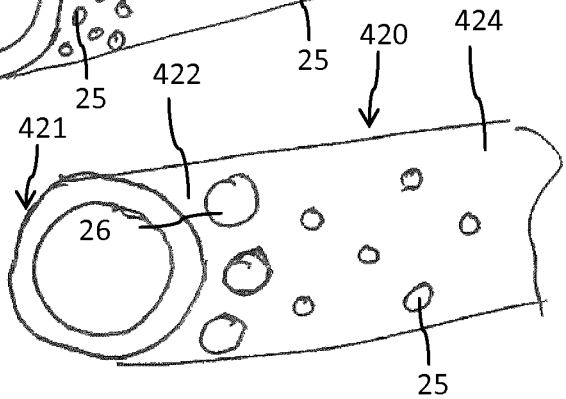
FIG. 7 shows still another embodiment of the extraction tube and FIG. 8 is a block diagram of an injection device configured to engage with a container as shown in FIG. 1.

In the embodiment according to FIG. 7 at least two different types of drain holes 25, 26 are used. Also here, the extraction tube 420 comprises a distal end 421 formed by a first portion 422. In the region of the first portion 422 drain holes 26 are located that are larger than drain holes 25 provided in a second portion 424 longitudinally adjacent or longitudinally offset from the first portion 422. Here, the drain holes 25, 26 may have an equal or similar density per surface segment of the extraction tube 420, but the drain holes 26 provided at the first portion 422 are larger than the drain holes 25 provided at the second portion 424. In this way, the distal end 421 is structurally weakened compared to the second portion 424.

Figure 8:
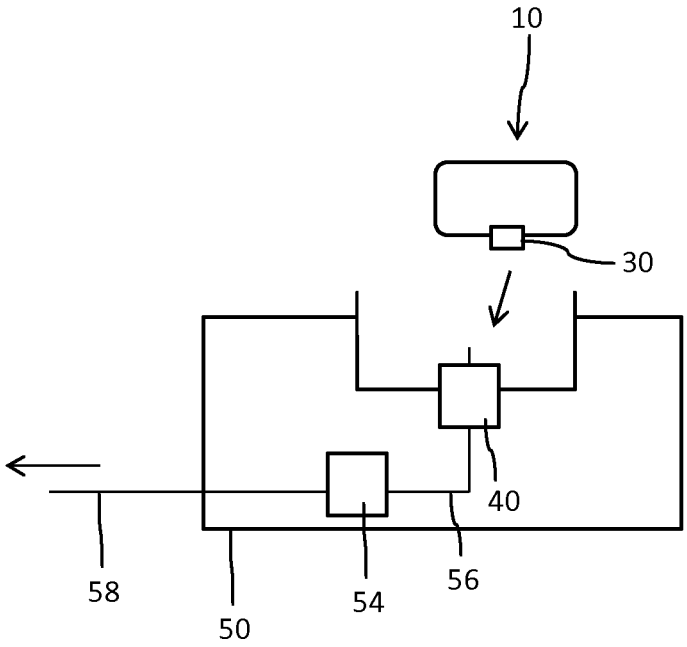

In FIG. 8 there is schematically illustrated an injection device 50 comprising a compartment 52 to receive and to accommodate a container 10 as described above. As schematically shown in FIG. 8, the injection device 50 comprises a pump 54 connected to a piercing assembly 40 via a tubing 56. The pump 54 is typically implemented as a suction pump to withdraw the liquid medicament from the interior 11 of the container 10 when connected to the tubing 56. A distal end of the tubing 56 is located inside or is connected to a piercing assembly 40 that is arranged inside the compartment 52 to connect with the container 10 via its interface member 30.

Once a fluid transferring interconnection of container 10 and piercing assembly 40 is established, the liquid medicament 18 can be withdrawn from the container 10 via the tubing 56. By means of the pump 54, the liquid medicament is transferrable towards a device outlet 58 and further to a patient.

LIST OF REFERENCE NUMBERS

10 container
11 inner volume
12 wall structure
12*a* inside-facing portion
13 sidewall
14 sidewall
15 seam
18 medicament
20 extraction tube
21 distal end
22 first portion
23 sidewall
24 second portion
25 drain hole
26 drain hole
27 proximal portion
30 interface member
32 seal
33 guiding structure
40 piercing assembly
43 fastening member
44 piercing element
45 prong
50 injection device
52 compartment
54 pump
56 tubing
58 device outlet
120 extraction tube
121 distal end
122 first portion
124 second portion
125 cross-section
220 extraction tube
221 distal end
222 first portion
223 sidewall
224 second portion
320 extraction tube
321 distal end
322 first portion
324 second portion
420 extraction tube
421 distal end
422 first portion
424 second portion

The invention claimed is:

1. A container for a liquid medicament, the container comprising:

a wall structure including a flexible portion and the wall structure defining an inner volume filled with the liquid medicament; and an elongated extraction tube having a first portion and a second portion that are separated from each other along the extraction tube and which are located inside the inner volume, wherein the extraction tube is configured to radially collapse when exposed to a compressive force above a predefined threshold, and wherein the first portion located at a distal end of the extraction tube is less resistive against radial collapsing than the second portion.

2. The container according to claim 1, wherein the extraction tube is flexible and has a mechanical flexibility lower than a flexibility of the flexible portion of the wall structure.

3. The container according to claim 1, wherein the extraction tube is fixed to an inside facing portion of the wall structure.

4. The container according claim 1, wherein at least the first portion of the extraction tube is free from the wall structure.

5. The container according to claim 1, wherein the first portion of the extraction tube comprises a side wall with a plurality of drain holes.

6. The container according to claim 5, wherein the side wall of the first portion comprises a first sidewall portion and a second sidewall portion separated along a circumference of the extraction tube from the first sidewall portion, wherein the first sidewall portion has a first non-zero radial thickness, wherein the second sidewall portion has a second non-zero radial thickness, and wherein the first non-zero radial thickness differs from the second non-zero radial thickness.

7. The container according to claim 5, wherein a number of drain holes per surface section in the first portion is larger than a number of drain holes per surface section in the second portion.

8. The container according to claim 1, wherein the first portion defines an oval cross section.

9. The container according to claim 8, wherein the second portion defines a substantially circular cross section.

10. The container according to claim 1, wherein the second portion defines a substantially circular cross section.

11. The container according to claim 1, wherein the first portion comprises drain holes larger than drain holes of the second portion.

12. The container according to claim 1, comprising an interface member extending through the wall structure to engage with a piercing assembly outside the wall structure.

13. The container according to claim 12, wherein the extraction tube comprises a proximal portion connected to the interface member.

14. The container according to claim 13, wherein the proximal portion of the extraction tube is blocked by a piercable seal.

15. The container according to claim 12, wherein the interface member comprises a guiding structure to engage with a fastening member of the piercing assembly.

16. An injection device for administering a liquid medicament, the injection device comprising:

a container comprising:

a wall structure with a flexible portion, the wall structure defining an inner volume configured to be filled with the liquid medicament; and an elongated extraction tube having a first portion and a second portion that are separated from each other along the extraction tube and which are located inside the inner volume, wherein the extraction tube is configured to radially collapse when exposed to a compressive force above a predefined threshold, and wherein the first portion located at a distal end of the extraction tube is less resistive against radial collapsing than the second portion.

17. The injection device according to claim 16, wherein the inner volume is filled with the liquid medicament.

18. The injection device of claim 16, further comprising a pump or a feeder mechanism operable to withdraw the liquid medicament from the inner volume of the container by way of suction.

* * * * *